US006746303B2

(12) United States Patent
Beidokhti

(10) Patent No.: US 6,746,303 B2
(45) Date of Patent: Jun. 8, 2004

(54) FLEXIBLE TOY FIGURE WITH WIRE ARMATURE

(75) Inventor: Noorolah Nader Beidokhti, Fountain Valley, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/448,705

(22) Filed: May 29, 2003

(65) Prior Publication Data

US 2004/0077278 A1 Apr. 22, 2004

Related U.S. Application Data

(60) Provisional application No. 60/385,255, filed on May 31, 2002.

(51) Int. Cl.[7] ..... A63H 3/04

(52) U.S. Cl. ..... 446/374; 446/385

(58) Field of Search ..... 446/373, 374, 446/375, 370, 385, 390, 376, 378, 379, 380, 381, 382, 383

(56) References Cited

U.S. PATENT DOCUMENTS

| | | | | |
|---|---|---|---|---|
| 280,986 | A | 7/1883 | Wishard | |
| 1,189,585 | A | 7/1916 | Kruse | |
| 1,551,250 | A | 8/1925 | Henry | |
| 1,590,898 | A | 6/1926 | McAuley | |
| 2,017,023 | A | 10/1935 | Rendle | |
| 2,073,723 | A | 3/1937 | Woolnough | |
| 2,109,422 | A | 2/1938 | Haughton | |
| 2,393,024 | A | 1/1946 | Couri | |
| 2,601,740 | A | 7/1952 | Schippert | |
| 2,684,503 | A | 7/1954 | Silver | |
| 3,277,601 | A | 10/1966 | Ryan | |
| 3,284,947 | A | 11/1966 | Dahl | |
| 3,325,939 | A | 6/1967 | Ryan et al. | |
| 3,395,484 | A | 8/1968 | Smith | |
| 3,624,691 | A | 11/1971 | Robson et al. | |
| 3,716,942 | A | 2/1973 | Garcia et al. | |
| 3,955,309 | A | 5/1976 | Noble | |
| 4,123,872 | A | 11/1978 | Silva | |
| 4,136,484 | A | 1/1979 | Abrams | |
| 4,197,358 | A | 4/1980 | Garcia | |
| 4,233,775 | A | 11/1980 | Neufeld | |
| 4,470,784 | A | 9/1984 | Piotrovsky | |
| 4,816,001 | A * | 3/1989 | Narvaez et al. | 446/370 |
| 4,932,919 | A | 6/1990 | Shapero | |

(List continued on next page.)

FOREIGN PATENT DOCUMENTS

| | | |
|---|---|---|
| JP | 49-18954 | 2/1974 |
| JP | 49-18955 | 2/1974 |
| JP | 60-97067 | 5/1985 |
| JP | 61-94090 | 5/1986 |
| JP | 61-94091 | 5/1986 |
| JP | 61-94092 | 5/1986 |
| JP | 62-53686 | 3/1987 |
| JP | 62-164092 | 7/1987 |
| JP | 63-103685 | 7/1988 |
| JP | 11-221369 | 8/1999 |
| WO | WO0067869 | 6/2000 |
| WO | WO0100665 | 1/2001 |
| WO | WO0108776 | 2/2001 |

OTHER PUBLICATIONS

International Search Report, PCT Application PCT/US03/17287, issued Aug. 23, 2003.

*Primary Examiner*—Jacob K. Ackun, Jr.
(74) *Attorney, Agent, or Firm*—Kolisch Hartwell, P.C.

(57) ABSTRACT

An improved posable figure, having extended life and resistance to failure, and being repeatedly posable in a realistic fashion. The posable figure includes an inner armature constructed of a plurality of strands of wire, and an outer molded body covering constructed of a flexible substance such as a thermoplastic material, commonly a soft polyvinyl chloride material. The armature includes a plurality of junctures, which may be spot welded, connecting the strands of wire to form an articulated structure.

29 Claims, 6 Drawing Sheets

U.S. PATENT DOCUMENTS

| | | | | |
|---|---|---|---|---|
| 4,954,118 | A | | 9/1990 | Refabert |
| 4,964,836 | A | | 10/1990 | Kamei |
| 5,017,173 | A | | 5/1991 | Shapero et al. |
| 5,516,314 | A | | 5/1996 | Anderson |
| 5,630,745 | A | | 5/1997 | Yeh |
| 5,741,140 | A | * | 4/1998 | Bristol ..... 434/82 |
| 5,762,531 | A | | 6/1998 | Witkin |
| 5,800,242 | A | | 9/1998 | Clokey |
| 6,074,270 | A | | 6/2000 | Wilcox et al. |
| 6,155,904 | A | | 12/2000 | Spector |
| 6,217,406 | B1 | | 4/2001 | Ross |

* cited by examiner

FLEXIBLE TOY FIGURE WITH WIRE ARMATURE

CROSS REFERENCE TO RELATED APPLICATION

The present application claims priority from U.S. Provisional Patent Application Ser. No. 60/385,255, filed May 31, 2002, incorporated herein by reference in its entirety for all purposes.

FIELD OF THE INVENTION

The present disclosure relates generally to flexible doll toys and action figure toys. More particularly, it includes dolls and action figures in which the outer surface of the toy is a soft, flesh-like material, and an inner skeleton includes a bendable armature.

BACKGROUND OF THE INVENTION

Many different varieties of flexible dolls and action figures have been developed over the years, mainly for the purposes of entertainment and display. Creation of a flexible or posable figure generally requires creation of a movable articulated body and limbs, ideally configured to retain whatever pose the figure is placed into. Furthermore, it is desirable that the figure be posable a large number of times without failure of the structure.

One class of posable figures includes an inner armature or skeleton including joints to recreate the articulation of a human skeleton, and a molded outer covering or body constructed of a flexible material that surrounds and is bonded or otherwise anchored to the inner armature. Examples of such toys are found in U.S. Pat. Nos. 280,986, 1,189,585, 1,551,250, 1,590,898, 2,017,023, 2,073,723, 2,109,422, 2,392,024, 2,601,740, 2,684,503, 3,325,939, 3,284,947, 3,395,484, 3,624,691, 3,955,309, 4,123,872, 4,136,484, 4,233,775, 4,932,919, 4,954,118, 4,964,836, 5,516,314, 5,630,745, 5,762,531, 5,800,242, 6,155,904, and 6,217,406, and in publications JP49-18954, JP49-18955, JP60-97067, JP61-94090, JP61-94091, JP61-94092, JP62-53686, JP62-164092, JP63-103685, JP11-221369, WO0067869, and WO0010665. Other examples of flexible doll toys and action figure toys are found in U.S. Pat. Nos. 3,277,601, 3,716,942, 4,470,784, 4,932,919, 5,017,173, and 6,074,270, and in publication WO0108776. The disclosures of all of these patents and publications are incorporated herein by reference.

SUMMARY OF THE INVENTION

An improved posable figure is provided, having extended life and resistance to failure, and being repeatedly posable in a realistic fashion. The posable figure includes an inner armature constructed of a bendable material such as a plurality of strands of wire, and an outer molded body covering constructed of a flexible substance such as an elastomer material, commonly a thermoplastic elastomer such as a soft polyvinyl chloride material. The armature includes a plurality of junctures between the strands of wire, which may be spot welded, connecting the strands of wire to form an articulated structure.

The advantages of the posable figure provided will be understood more readily after a consideration of the Drawings and the Detailed Description of the Preferred Embodiment.

DETAILED DESCRIPTION OF THE PREFERRED EMBODIMENT

Figure 1:
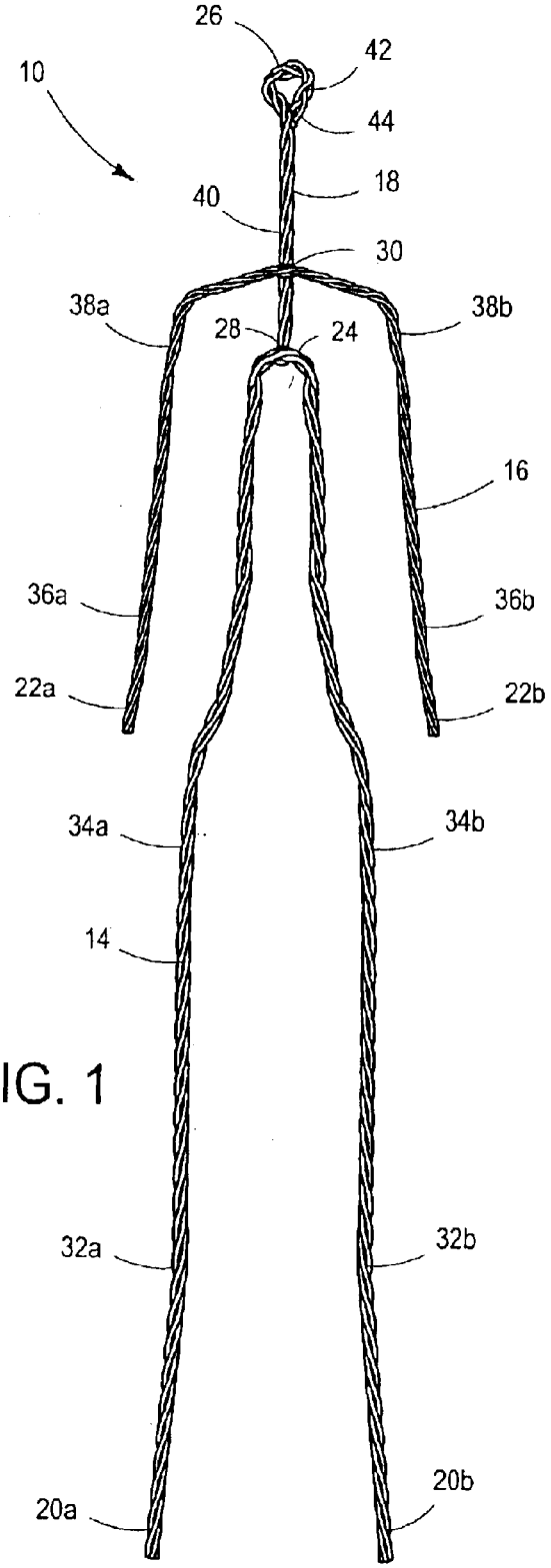
FIG. 1 is a front elevation view of an armature for a posable figure, according to an embodiment of the invention.
Figure 2:
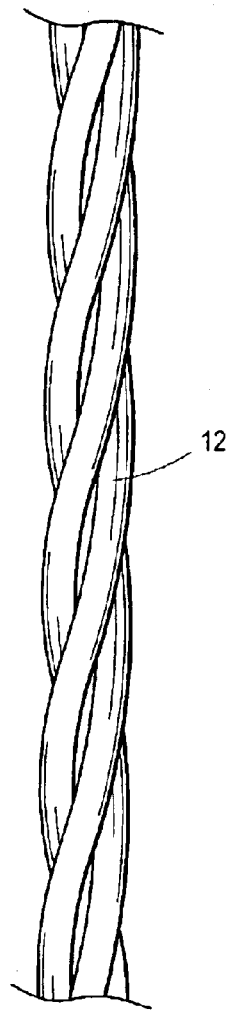
FIG. 2 is a magnified view of a portion of the armature of FIG. 1, showing details of the twisted wire structure of the armature.

Referring to FIG. 1, an armature 10 for a posable figure is shown. Although it is anticipated that armature 10 will eventually be enclosed by and bonded to an outer covering, such as an injection-molded body of a posable figure, FIG. 1 shows the inner core of the armature in isolation for clarity. Armature 10 may include a plurality of twisted strands of wire 12, best seen in FIG. 2, which may be joined together to form an articulated structure. As depicted in FIG. 2, strands 12 may be constructed from three pliable metal wires twisted together, although other suitable numbers of wires and/or materials may be used to construct the inner armature of the invention.

As depicted in FIG. 1, armature 10 may include a lower strand 14, a middle strand 16, and an upper strand 18. Lower strand 14 may extend from a first foot portion 20*a* to a second foot portion 20*b*, and middle strand 16 may extend from a first hand portion 22*a* to a second hand portion 22*b*. Upper strand 18 may extend from an upper portion 24 of the lower strand, to a head portion 26.

The strands of wire in the armature may be connected at junctures 28 and 30 to form a unitary structure. As indicated, juncture 28 may connect lower strand 14 to upper strand 18 at a point at or near a lower end of the upper strand, so that the upper strand may not extend appreciably below its intersection with the lower strand at juncture 28. Juncture 30 may connect the middle strand to the upper strand at a point between juncture 28 and head portion 26. Junctures 28 and 30 may be formed, for example, by spot welding, although other forms of adhesion such as gluing, crimping, or the like may also be suitable for forming connections between the strands of wire.

As depicted in FIG. 1, armature 10 may be formed into an articulating structure that includes lower leg portions 32*a* and 32*b*, upper leg portions 34*a* and 34*b*, lower arm portions 36*a* and 36*b*, upper arm portions 38*a* and 38*b*, and a neck portion 40. For simplicity, symmetric pairs of parts such as the leg and arm portions, among numerous others, may hereinafter be referred to by a single reference number. Thus, "lower leg portions 32" will be understood to mean lower leg portions 32*a* and 32*b*, and so forth.

The strands of wire may be chosen to have any diameter that permits a desired amount of flexibility in the various regions of the armature. For example, lower strand 14 and upper strand 18 may be formed from twisted wires that are approximately 0.030-inches in diameter, and middle strand 16 may be formed from a twisted wire that is approximately 0.025-inches in diameter. However, it will be appreciated that wires of other diameters may be equally suitable or more suitable for various designs, depending on the overall size of the posable figure and its intended use.

In the embodiment depicted in FIG. 1, a distal end of upper strand 18 forms head portion 26 in the shape of a substantially circular loop 42 that is spot welded to neck portion 40 at an upper juncture 44. However, it should be appreciated that the head portion may be suitably formed in various other ways. For example, FIG. 3 shows an embodiment in which a head portion 126 is formed in the shape of a curved hook or semi-loop 46.

Figure 3:
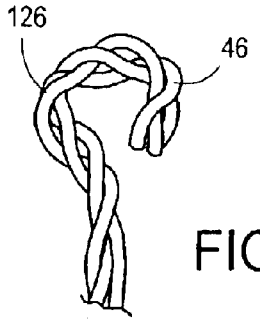
FIG. 3 is a front view of a head portion of an armature for a posable figure, according to another embodiment of the invention.

In FIGS. 1–3, the various wire strands 14, 16, and 18 that are included in armature 10 are shown before any injection molding steps involving the toy figure have been performed. Such injection molding may typically be performed in a two-step process. In the first injection molding step, a plurality of structures may be injection molded around the inner wire, to form a more rigid and substantial inner skeleton. In the second injection molding step, a flesh-like outer covering may be molded around the skeleton to form a surrounding body, which may enclose both the inner wire armature and portions of rigid structures that were added in the first step. These two injection molding steps are described below in greater detail.

Figure 4A:
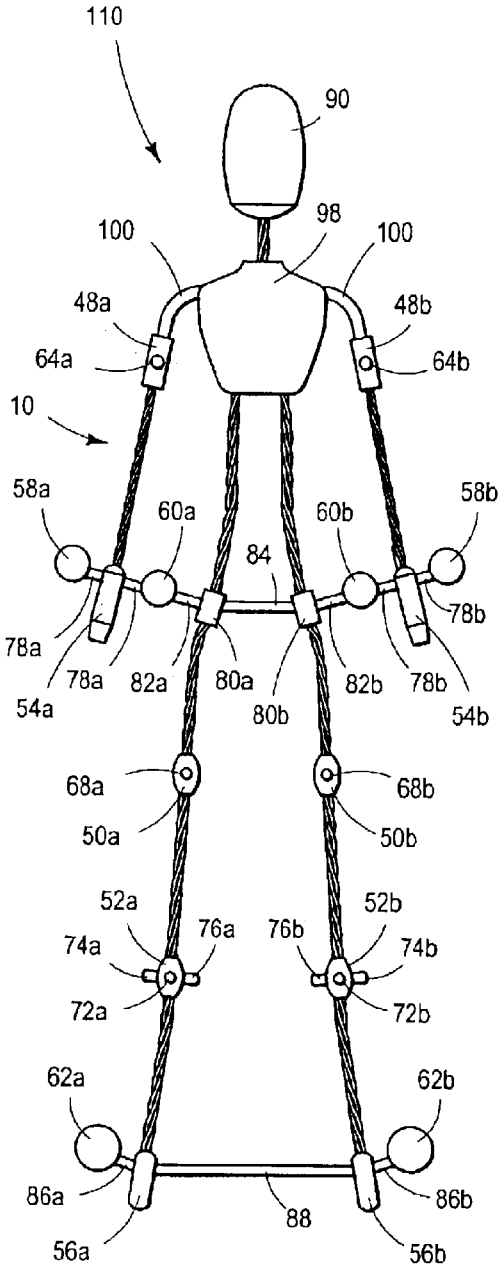
FIG. 4A is a front elevation view of a partially formed posable figure, after one step of insert molding.
Figure 4B:
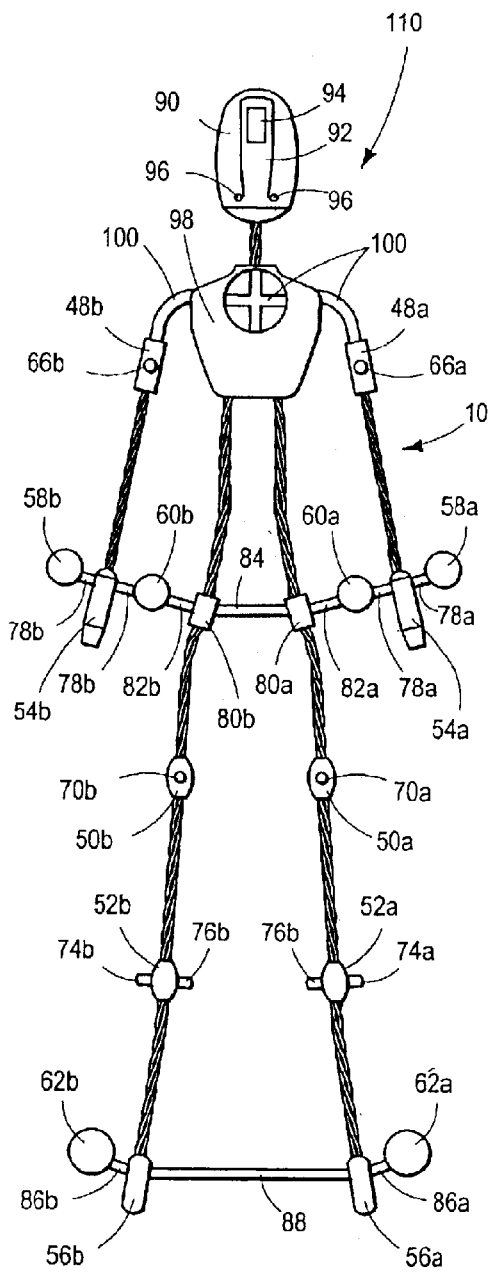
FIG. 4B is a rear elevation view of the partially formed posable figure of FIG. 4A.

FIGS. 4A and 4B show front and rear elevation views, respectively, of a partially formed posable FIG. 110, after a first injection molding step has been performed. After the first injection molding step, partially formed FIG. 110 may include wire armature 10 as described above, as well as a plurality of support members. These support members may include surrounding members 48, 50, and 52, end caps 54 and 56, and sprues 58, 60, and 62, among others. The support members may extend outward from the strands of wire, adding structure and stability to armature 10. As described below, some of the support members may also allow partially formed FIG. 110 to be located accurately and conveniently in a mold, prior to a second injection molding step.

The support members may be constructed from any suitable material, such as a resin material that may be conveniently molded around wire armature 10 in molten form. The support member material may, for example, be a relatively flexible polymer material such as polypropylene, or it may be a more rigid polymer such as polyethylene. The support member material may also be a thermoplastic elastomer material such as polyvinylchloride (PVC), or a styrene-based elastomer such as a Kraton material manufactured by Kraton Polymers of Houston, Tx. In some embodiments, this material may be chosen to bond and/or be otherwise compatible with a material used for the outer covering of the toy figure.

Figure 5A:
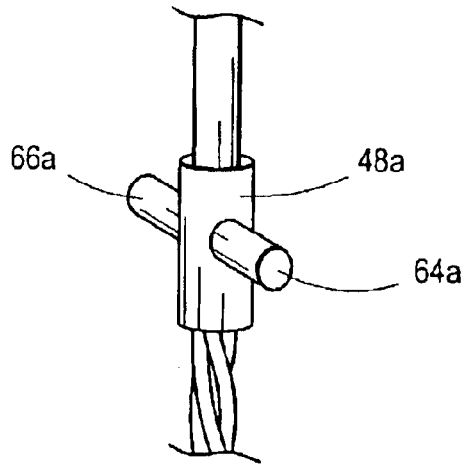
FIG. 5A is a magnified view of a portion of the partially formed posable figure of FIGS. 4A and 4B, showing details of upper arm locating pegs.
Figure 5B:
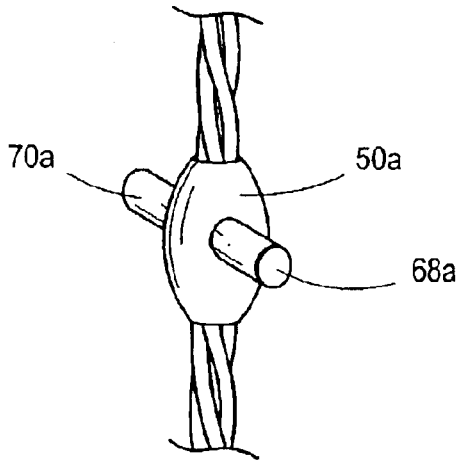
FIG. 5B is a magnified view of a portion of the partially formed posable figure of FIGS. 4A and 4B, showing details of upper leg locating pegs.
Figure 5C:
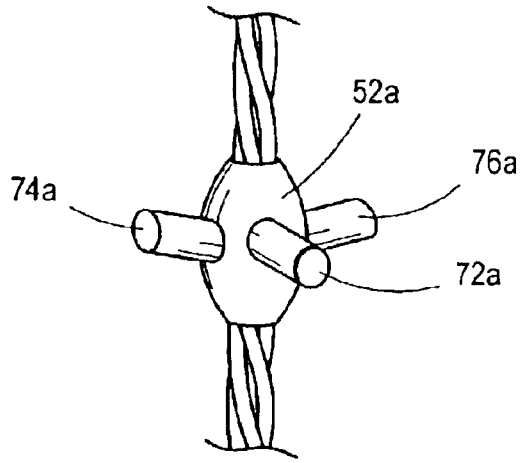
FIG. 5C is a magnified view of a portion of the partially formed posable figure of FIGS. 4A and 4B, showing details of lower leg locating pegs.

Surrounding members 48, 50, and 52 each may be configured to surround a portion of the wire of armature 10, and each may include a plurality of locating pegs extending substantially radially outward from the wire. For example, surrounding member 48 may include upper arm pegs 64 and 66, surrounding member 50 may include upper leg pegs 68 and 70, and surrounding member 52 may include lower leg pegs 72, 74, and 76. The locating pegs may be substantially cylindrical as depicted in FIGS. 4 and 5, or they may have any other suitable shape. For example, the locating pegs may be substantially conical or frustoconical. The locating pegs may also have rounded ends.

FIG. 5 shows details of the structure of surrounding members 48, 50, and 52, and their associated locating pegs. The locating pegs may be configured to assist in locating partially formed FIG. 110 in a mold, in preparation for a second injection molding step. As indicated, upper arm pegs 64, upper leg pegs 68, and lower leg pegs 72 may extend forward and away from the armature, upper arm pegs 66 and upper leg pegs 70 may extend backward and away from the armature, lower leg pegs 74 may extend laterally and away from the armature, and lower leg pegs 76 may extend medially and away from the armature.

Providing locating pegs of the type just described may help to position partially formed FIG. 110 in a desired location within a mold. For example, a particular locating peg may be configured to substantially span a radius of the mold, thereby holding a wire strand of the armature spaced away from the walls of the mold. This may allow material to be injected into the mold to form a continuous molded body, encasing and bonded to the armature, with the wires of the armature spaced away from the surface of the body.

As depicted in FIGS. 4A and 4B, end caps 54 and 56 may be disposed to cover free ends of lower strand 14 and/or middle strand 16. In other words, the end caps may be disposed to cover foot portions 20 and/or hand portions 22 of the inner wire armature. End caps 54 and 56 may hold loose ends of the wires together, and may reduce the chances that an end of one of the wires will break through the body of the toy.

Sprues 58, 60, and 62, which may be substantially cylindrical, may serve to further locate partially formed FIG. 110 in a mold during a second injection molding step. For example, the sprues may be placed in corresponding cylindrical depressions or recesses in the mold, to hold the armature in position while a surrounding body is injection molded around partially formed FIG. 110.

As depicted in FIGS. 4A and 4B, sprues 58 and 60 may be disposed near end caps 54, and attached to the end caps by connecting shafts 78. In addition, sprues 60 may be attached to surrounding members 80 by shafts 82, and surrounding members 80 may be attached to each other by a connecting shaft 84. In this manner, sprues 58 and 60, connecting shafts 82 and 84, and surrounding members 80 all form a substantially continuous structure for locating the partially formed figure in a mold, and supporting it there during a second injection molding step. Similarly, sprues 62 may be connected to end caps 56 by connecting shafts 86, and end caps 56 may be connected to each other by a connecting shaft 88, as indicated.

Aside from the aforementioned structures, a molded head portion 90 may also be added during the first injection molding step. Molded head portion 90 may include a rear section 92 extending in slight relief from the remainder of the molded head portion. Rear section 92 may include a substantially rectangular aperture 94, and two smaller circular apertures 96. Apertures 94 and/or 96 may be used for additional secure positioning of partially formed FIG. 110 in a second mold, for instance using shafts, pins, or the like to extend from the mold into the apertures.

A chest portion 98 may also be added during the first injection molding step. Furthermore, portions of the inner wires may be covered with a relatively thin coating of material, generally indicated at 100. The additional structure of chest portion 98 and wire coating 100 may serve to selectively increase the rigidity of portions of the toy figure, and to provide greater stability to the partially formed figure prior to a second injection molding step.

Figure 6A:
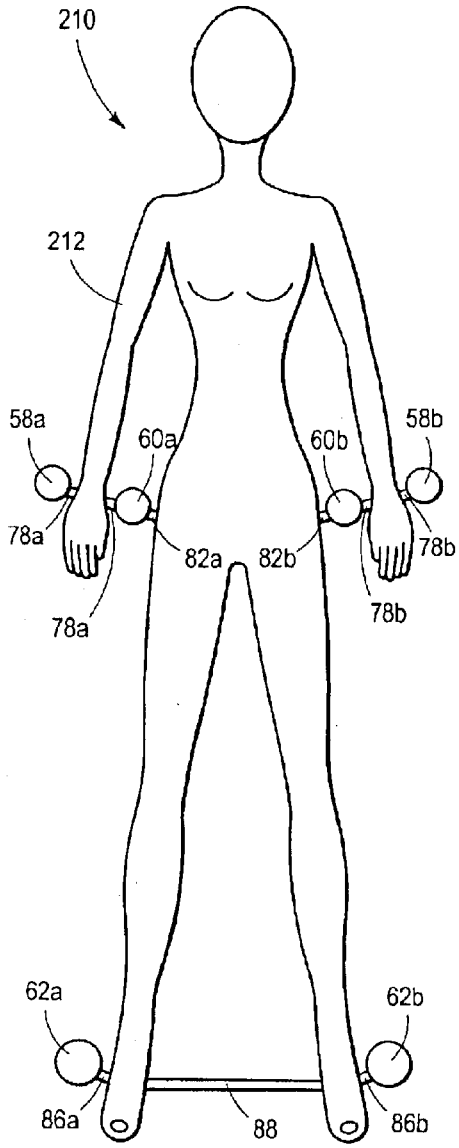
FIG. 6A is a front elevation view of a posable figure after two steps of insert molding, according to an embodiment of the invention.
Figure 6B:
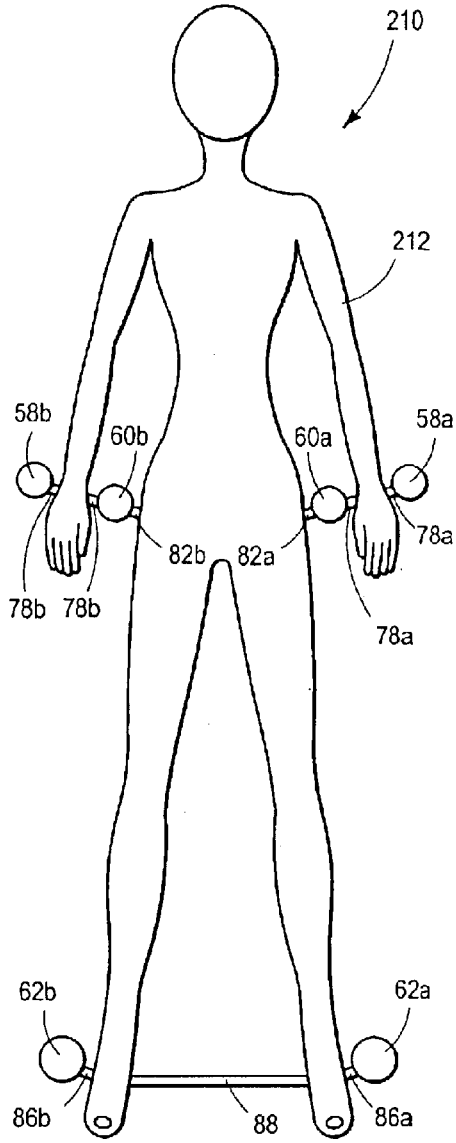
FIG. 6B is a real elevation view of the posable figure of FIG. 6A.
Figure 7:
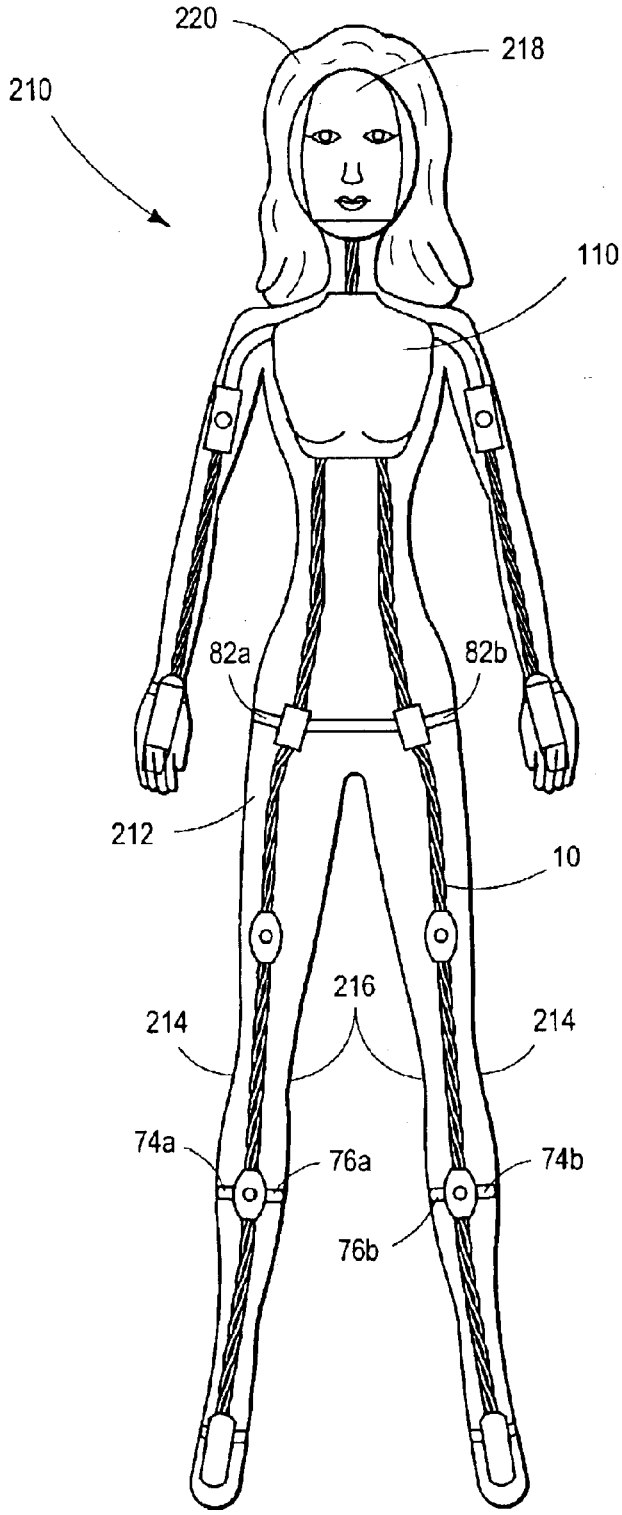
FIG. 7 is a semi-transparent front elevation view of the posable figure of FIGS. 6A and 6B, showing an armature and a molded body enclosing the armature.
Figure 8:
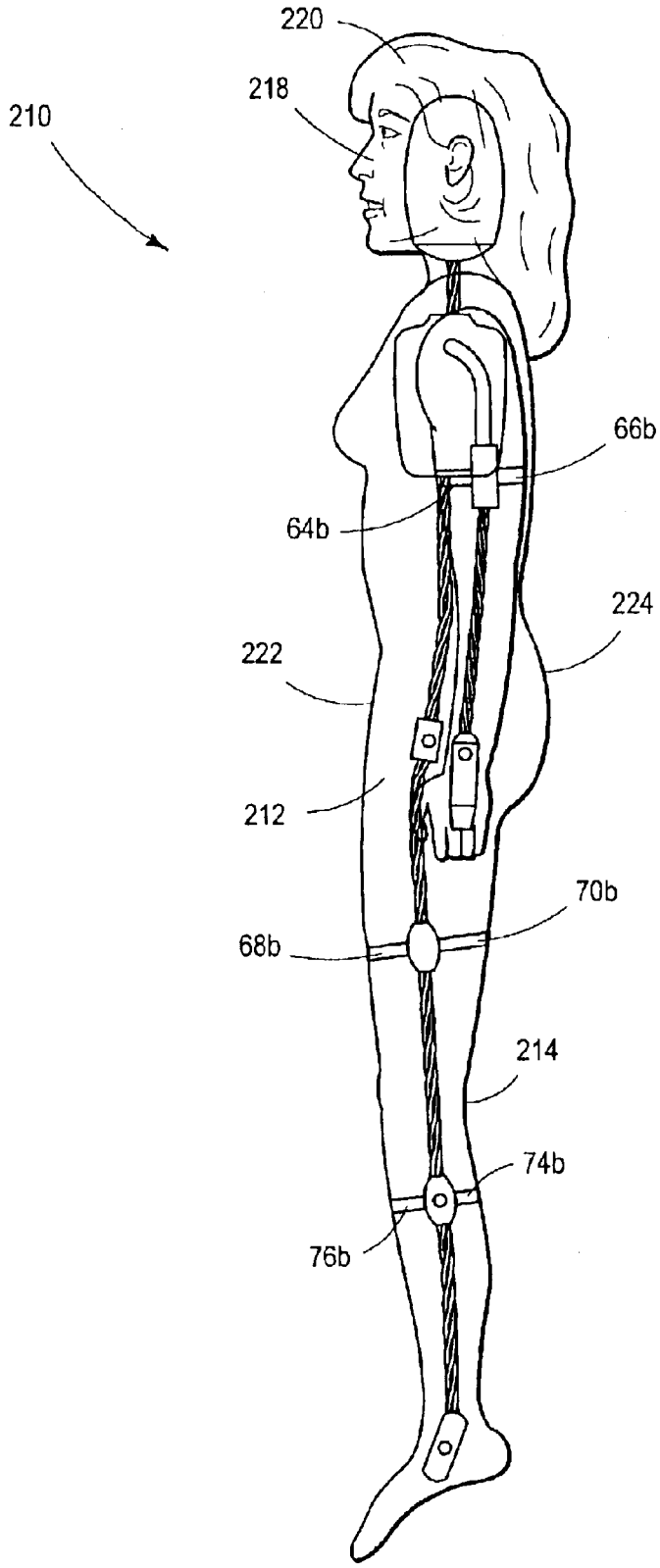
FIG. 8 is a semi-transparent side elevational view of the posable figure of FIG. 7.

FIGS. 6–8 show a toy figure, generally indicated at 210, after two steps of injection molding. As is best seen in FIGS. 7–8, toy FIG. 210 may include partially formed FIG. 110 (including armature 10), and also a surrounding and continuously molded body 212. Body 212 may be constructed from any resilient, flexible material, such as a highly elastic thermoplastic material such as a soft polyvinyl chloride (PVC) material having a Shore hardness of approximately 65. The body material may be colored to match the desired finished color of the posable figure, but the body material is depicted as transparent in FIGS. 7–8, so that partially formed FIG. 110 may be seen disposed within it.

Although in general, any suitable material may be used to construct the body of the toy figure, in some embodiments the body material may be chosen to bond to and/or be otherwise compatible with the material used for the support members of the armature of the toy figure. For example, the body material and the support member material may both be constructed from styrene-based elastomers such as a Kraton material, with either similar or different Shore hardnesses. Such similar elastomers may tend to bond particularly securely to each other during injection molding of the body around the armature.

FIGS. 6A and 6B show front and rear views, respectively, of toy FIG. 210 after a second step of injection molding but before final finishing of the toy figure is complete. Sprues 58, 60, and 62 may still be attached externally to FIG. 210 after the second molding step. Similarly, portions of connecting shafts 78, 82, 86, and/or 88 may remain outside of body 212 after the second molding step. The protruding sprues and/or shafts, if any, may be cut or broken off of toy FIG. 210 as part of final finishing steps.

FIG. 7 shows a front view of toy FIG. 210 after some final finishing steps, with the material of molded body 212 depicted as transparent so that armature 10 may be seen within the figure. As depicted in FIG. 7, locating pegs 74 and 76 may extend to lateral and media surfaces 214 and 216 of the body, respectively. Also as depicted in FIG. 7, various finishing steps may be applied to the toy figure after the second injection molding step. For example, sprues and/or connecting shafts that remain external to molded body 212 may be removed, possibly leaving portions of shafts 82 extending to surfaces of the body. Facial features, generally indicated at 218, may be added by, for example, etching and/or painting. Hair 220 may be attached to the figure by, for example, heat sealing or gluing. In some embodiments, clothing and/or other accessories may be added to the figure.

FIG. 8 shows a right side view of toy FIG. 210, with the material of molded body 212 depicted as transparent as in FIG. 7. As depicted in FIG. 8, locating pegs 64, 68, and 72 may extend to an anterior surface 222 of the body, and locating pegs 66 and 70 may extend to a posterior surface 224 of the body. End portions of the various locating pegs extending to surfaces of the body may be sanded or otherwise smoothed as desired, as a final finishing step.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

I claim:

1. An armature for use in a poseable figure, comprising:

a plurality of twisted strands of wire including a lower strand extending from a first foot portion to a second foot portion, a middle strand extending from a first hand portion to a second hand portion, and an upper strand extending from an upper portion of the lower strand to a head portion; and a plurality of junctures interconnecting selected ones of the strands of wire to form an articulated structure.

2. The armature of claim 1, wherein the lower strand and the middle strand are connected to the upper strand.

3. The armature of claim 1, wherein the lower strand and the middle strand are connected to the upper strand by spot welding.

4. The armature of claim 3, wherein each strand includes exactly three twisted wires.

5. The armature of claim 2, wherein each strand includes exactly three twisted wires.

6. The armature of claim 2, wherein the upper strand is bent substantially into a circle to form the head portion.

7. The armature of claim 2, wherein the upper strand is bent substantially into a hook to form the head portion.

8. The armature of claim 2, further comprising a plurality of support members extending outward from selected ones of the strands of wire.

9. The armature of claim 8, wherein the support members include a plurality of locating pegs extending substantially radially outward from selected ones of the strands of wire.

10. The armature of claim 9, wherein the locating pegs include upper arm pegs, upper leg pegs, and lower leg pegs.

11. The armature of claim 10, wherein the upper arm pegs and the upper leg pegs each include pegs extending toward an anterior surface of the armature and pegs extending toward a posterior surface of the armature.

12. The armature of claim 11, wherein the lower leg pegs include pegs extending toward an anterior surface of the armature, pegs extending toward a lateral surface of the armature, and pegs extending toward a medial surface of the armature.

13. The armature of claim 9, wherein the support members include a plurality of end caps covering free ends of selected ones of the strands of wire, and a plurality of locating sprues attached to the end caps by shafts.

14. The armature of claim 13, wherein the end caps cover free ends corresponding to the hand portions and the foot portions.

15. The armature of claim 2, wherein the support members include a plurality of end caps covering free ends of selected ones of the strands of wire.

16. A posable figure, comprising:

an armature formed to receive an outer covering, the armature including a lower strand of wire extending from a first foot portion to a second foot portion, a middle strand of wire extending from a first hand portion to a second hand portion, an upper strand of wire intersecting the middle wire and extending from an upper portion of the lower strand to a head portion, and a plurality of spot-welded junctures interconnecting selected ones of the strands of wire to form an articulated structure; and a continuous molded body encasing the armature.

17. The posable figure of claim 16, wherein the body is formed of a highly elastic thermoplastic material.

18. The posable figure of claim 17, wherein the body is formed of a polyvinyl chloride material.

19. The posable figure of claim 17, the armature further comprising a plurality of support members extending outward from selected ones of the strands of wire.

20. The posable figure of claim 19, wherein the support members include a plurality of locating pegs extending substantially radially outward from selected ones of the strands of wire to an outer surface of the body.

21. The posable figure of claim 20, wherein the locating pegs include upper arm pegs, upper leg pegs, and lower leg pegs.

22. The posable figure of claim 21, wherein the upper arm pegs and the upper leg pegs each include pegs extending to an anterior surface of the body and pegs extending to a posterior surface of the body.

23. The posable figure of claim 22, wherein the lower leg pegs include pegs extending to an anterior surface of the body, pegs extending to a lateral surface of the body, and pegs extending to a medial surface of the body.

24. The posable figure of claim 23, wherein the support members include a plurality of end caps covering free ends of the lower strand and free ends of the middle strand.

25. The posable figure of claim 24, wherein the support members include a plurality of locating sprues attached to the end caps by shafts.

26. A method of manufacturing a posable figure, comprising:

insert molding a plurality of support members extending outward from a flexible wire armature; and insert molding a continuous body encasing the armature;

wherein the armature includes a plurality of strands of wire; and wherein the support members include:

a plurality of locating pegs extending substantially radially outward from selected ones of the strands of wire;

a plurality of end caps covering free ends of selected ones of the strands of wire; and a plurality of cylindrical locating sprues attached to the end caps by shafts.

27. The method of claim 26, further comprising supporting the armature with the support members, in a position spaced away from inner walls of a mold.

28. The method of claim 27, wherein the locating pegs extend to an outer surface of the body.

29. The method of claim 27, wherein the end caps cover free ends corresponding to hand portions and foot portions of the armature.

* * * * *